United States Patent [19]

Panten et al.

[11] Patent Number: 5,065,719

[45] Date of Patent: Nov. 19, 1991

[54] ACTUATING DEVICE FOR A THROTTLE VALVE ARRANGED IN AN INTAKE PIPE OF A DIESEL INTERNAL COMBUSTION ENGINE

[75] Inventors: Detlef Panten, Xorb; Gernot Hertweck, Fellbach; Franz Bender, Wendlingen, all of Fed. Rep. of Germany

[73] Assignee: Mercedes-Benz AG, Fed. Rep. of Germany

[21] Appl. No.: 584,798

[22] Filed: Sep. 19, 1990

[30] Foreign Application Priority Data

Sep. 19, 1989 [DE] Fed. Rep. of Germany ..... 3931144

[51] Int. Cl.[5] ..... F02D 9/10; F02D 11/08

[52] U.S. Cl. ..... 123/339; 123/389; 123/400; 123/401

[58] Field of Search ..... 123/339, 341, 342, 389, 123/396, 400, 401

[56] References Cited

U.S. PATENT DOCUMENTS

| | | | |
|---|---|---|---|
| 2,902,013 | 9/1959 | Biermann | 123/339 |
| 3,348,625 | 10/1967 | Thorner | 123/389 |
| 4,010,720 | 3/1977 | Gram | 123/396 |
| 4,848,297 | 7/1989 | Hickmann et al. | 123/342 |
| 4,919,097 | 4/1990 | Mitui et al. | 123/400 |
| 4,991,552 | 2/1991 | Luft et al. | 123/401 |
| 5,005,546 | 4/1991 | Mann | 123/339 |

FOREIGN PATENT DOCUMENTS

| | | |
|---|---|---|
| 0192962 | 9/1986 | European Pat. Off. . |
| 7906825 | 3/1979 | Fed. Rep. of Germany . |
| 2939805 | 4/1980 | Fed. Rep. of Germany . |
| 1367809 | 7/1963 | France . |
| 2592093 | 6/1987 | France . |
| 1563889 | 4/1980 | United Kingdom . |

*Primary Examiner*—Tony M. Argenbright
*Assistant Examiner*—Robert E. Mates
*Attorney, Agent, or Firm*—Evenson, Wands, Edwards, Lenahan & McKeown

[57] ABSTRACT

The invention relates to an actuating device for a throttle valve arranged in an intake pipe in a diesel internal combustion engine, having a mechanical adjusting linkage for the load-dependent adjustment of the throttle valve, the adjusting linkage having an idle path. In order to be able to control the throttle valve as a function of a plurality of operating parameters, an actuator actuated by an auxiliary force is proposed via which the throttle valve position predetermined as a function of load can be altered within the idle path.

2 Claims, 2 Drawing Sheets

ACTUATING DEVICE FOR A THROTTLE VALVE ARRANGED IN AN INTAKE PIPE OF A DIESEL INTERNAL COMBUSTION ENGINE

BACKGROUND AND SUMMARY OF THE INVENTION

The invention relates to an actuating device for a throttle valve arranged in an intake pipe of a diesel internal combustion engine, having a mechanical adjusting linkage for the load-dependent adjustment of the throttle valve, which linkage has an idle path decoupling the movement of the throttle valve from the movement of the accelerator pedal.

An actuating device of the generic design is known from German Patent Document DE-OS 2,939,805. The essential disadvantage of the known actuating device consists in the fact that the throttle valve can only be adjusted as a function of the load.

An object on which the invention is based is to create a device of the generic type by means of which throttle-valve control can be effected as a function of a plurality of operating parameters.

This object is achieved according to preferred embodiments of the invention by providing an arrangement wherein an actuator actuated by an auxiliary force is provided, via which actuator the throttle valve position predetermined as a function of load can be altered within an idle path of the actuator.

The actuating device according to the invention has the advantage that, due to the idle path in the actuating linkage, the throttle valve can now be controlled as a function of a very wide variety of operating parameters. Thus, for example, in an internal combustion engine with exhaust gas recirculation, it is possible to swivel the throttle valve out of the instantaneous load-dependent valve position into a position favorable for exhaust gas recirculation while the accelerator pedal position remains constant.

Other objects, advantages and novel features of the present invention will become apparent from the following detailed description of the invention when considered in conjunction with the accompanying drawings.

DETAILED DESCRIPTION OF THE DRAWINGS

Figure 1:
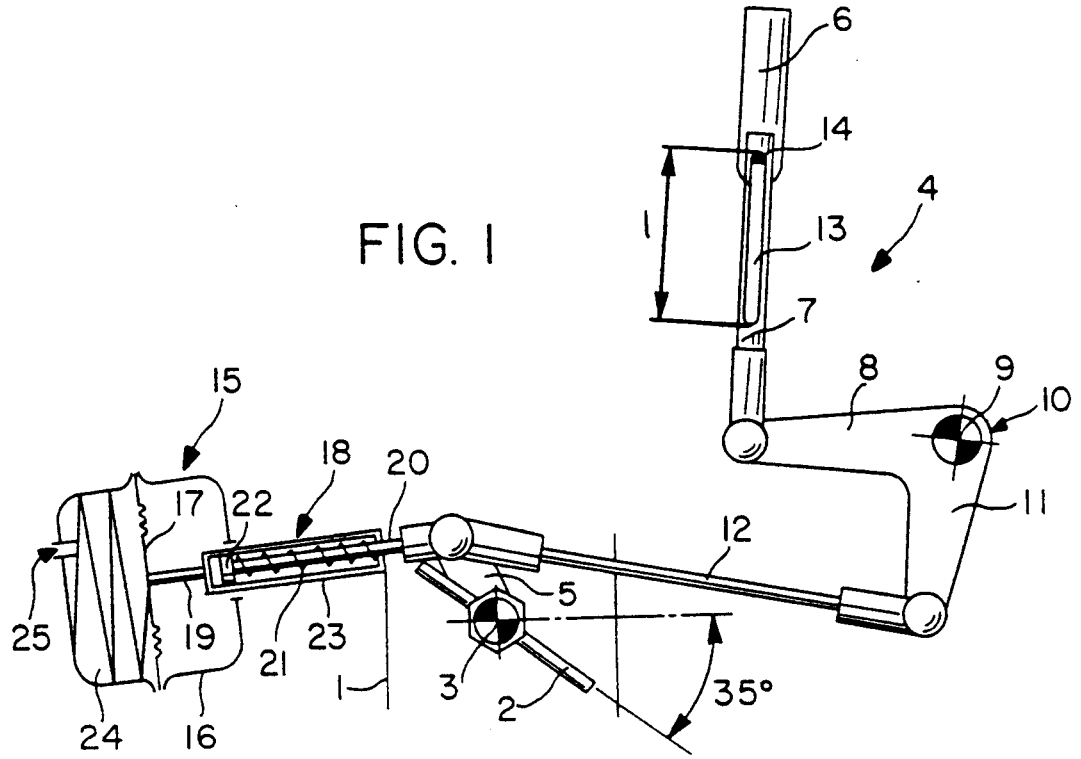
FIG. 1 is a schematic view which shows an actuating device constructed according to a preferred embodiment of the invention in the position for zero load with the actuator inactive.

A diesel internal combustion engine (not shown) has an intake pipe 1, in which a throttle valve 2 is rotatably mounted on a shaft 3. The throttle valve 2 is actuated via a mechanical adjusting linkage 4 that is articulated, on the one hand, on the accelerator pedal (not shown) and, on the other hand, on a driving lever 5 connected to the shaft 3 in a manner fixed in terms of rotation. In detail, the adjusting linkage 4 comprises two linkage sections 6 and 7, displaceable telescopically one inside the other, of which linkage section 6 is articulated on the accelerator pedal and linkage section 7 is articulated on the first swivel arm 8 of a bell-crank lever 10 pivotably supported on the crankcase via the pivot 9, and a connecting rod 12, which is articulated, on the one hand, on the second swivel arm 11 of the bell-crank lever 10 and, on the other hand, on the driving lever 5. Linkage section 7 has an elongate slot 13, in which is guided a sliding block 14, which is secured on linkage section 6. By virtue of the elongate slot 13 and the sliding block 14 guided in it, the linkage sections 6 and 7 can be pushed one inside the other over the idle path predetermined by the length "1" of the elongate slot 13, with the result that, over this idle path "1", the movement of the throttle valve is decoupled from the movement of the accelerator pedal.

According to the invention, the driving lever 5 of the throttle valve 2 is furthermore connected to an actuator 15 actuated by an auxiliary force, via which actuator the throttle valve position predetermined as a function of load can be altered within the idle path "1".

The actuator 15 is designed as a vacuum actuator and comprises a housing 16 in which is clamped a control diaphragm 17. Attached to the control diaphragm 17 is an actuating rod 18, which is coupled to the driving lever 5 of the throttle valve 2. The actuating rod 18 is composed of two linkage parts 19 and 20, displaceable telescopically one inside the other, which can be pulled apart counter to the force of a spring 21. At the free end, linkage part 20 has a piston 22, which is guided in a cylinder 23 connected to linkage part 19. The spring 21 is supported, on the one hand, against the rod-side face of the piston 22 and, on the other hand, against the cylinder, in such a way that the two linkage parts 19 and 20 can only be pulled apart counter to the force of the spring 21.

In the housing 16 of the actuator 15, on that side of the diaphragm 17 which faces away from linkage part 19, is a control space 24, which is connected to a vacuum source (not shown) via a vacuum connection 25. The control diaphragm 17 can be switched between two end positions. With the control space 24 ventilated, the control diaphragm 17 is in the end position represented in FIG. 1. If the control space 24 is subjected to a vacuum, the control diaphragm 17 is in its alternative position, as represented in FIG. 2. By virtue of the movement of the control diaphragm 17, linkage part 19 is displaced by a predetermined stroke "h".

Figure 2:
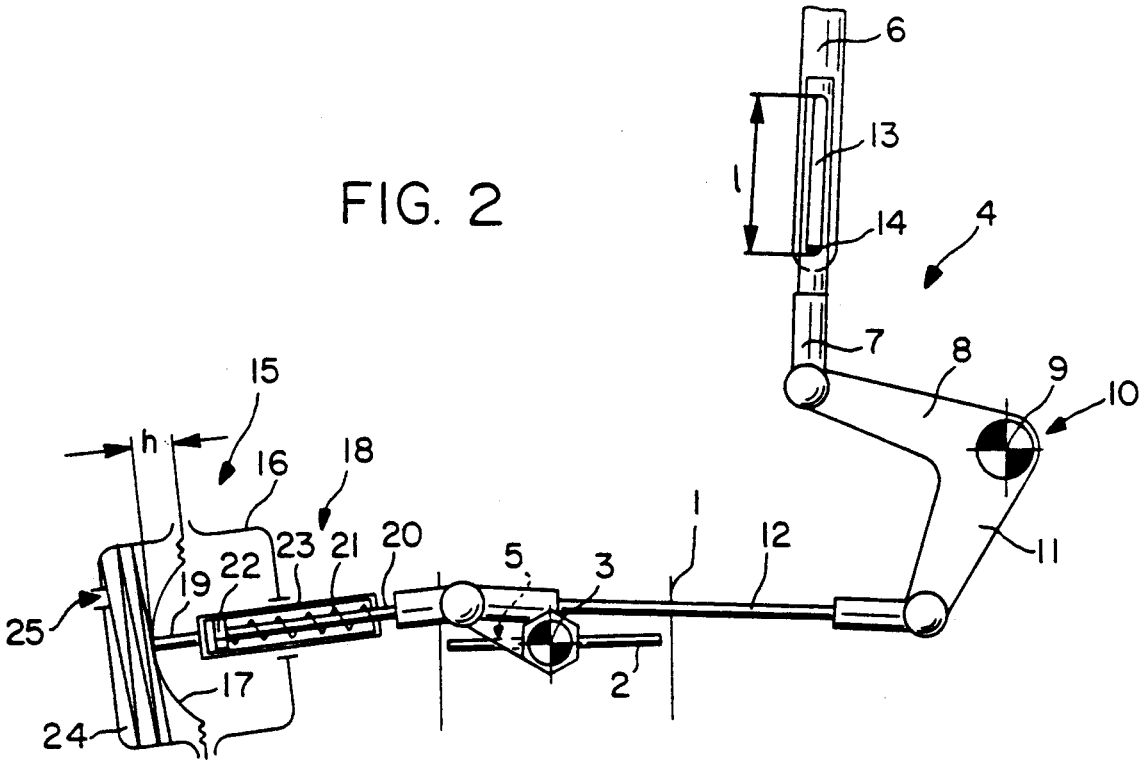
FIG. 2 shows the actuating device of FIG. 1 in the position for zero load with the actuator active.

The mode of operation of the device according to the invention is as follows:

Assuming that zero load has been specified via the accelerator pedal, the actuating device is in the position shown in FIG. 1. The vacuum actuator 15 is here ventilated, the throttle valve 2 thereby being held in a partially opened position (about 35° C.) via the actuating rod 18. At the same time, the two linkage sections 6 and 7 of the adjusting linkage 4 are in the position pulled apart by the idle path "1". Starting from this position, an increase in the load via the accelerator pedal by the idle path "1" has no influence on the position of the throttle valve 2. After displacement of linkage section 6 by the idle path "1", the sliding block 14 comes to rest against linkage section 7, with the result that, in the case of a further actuation of the accelerator pedal, the throttle valve 2 is adjusted proportionally to the accelerator pedal.

Figure 3:
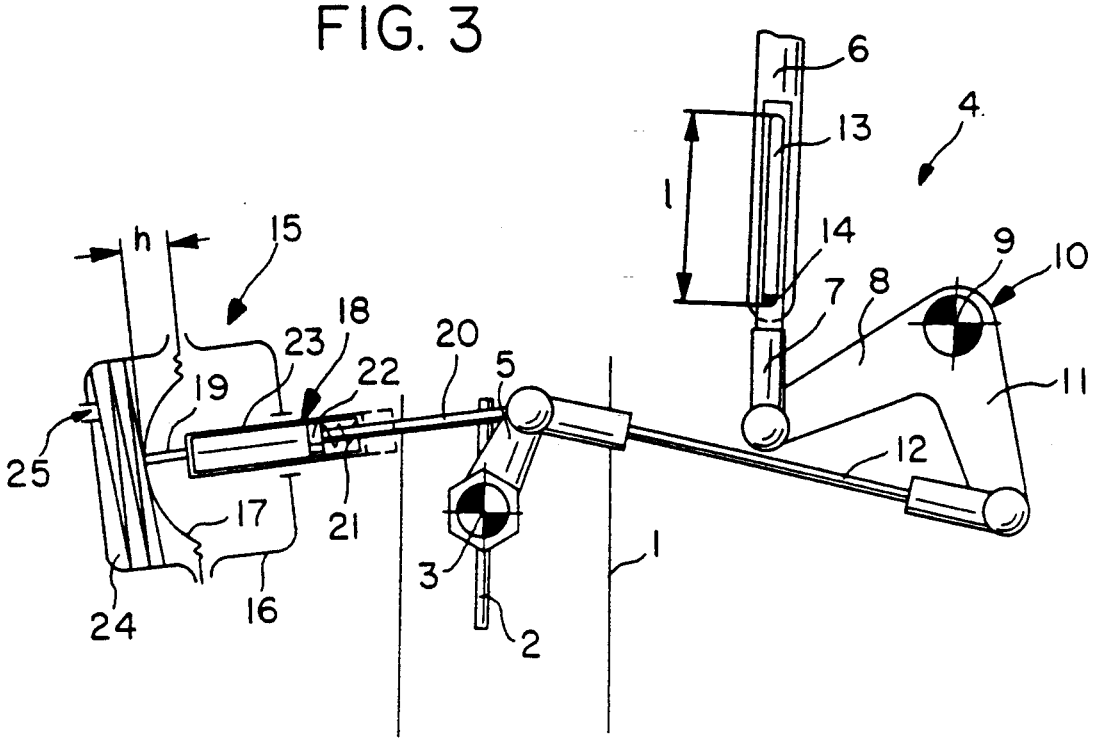
FIG. 3 shows the actuating device of FIG. 1 in the position for full load with the actuator active.

Starting from the position of the adjusting linkage 4 in FIG. 1, the actuator 15 has, in FIG. 2, been subjected to a vacuum, the movement of the actuating rod 18 by the stroke "h" swivelling the throttle valve 2 into the closed position. Linkage section 7 is thereby simultaneously displaced by the idle path "1" in such a way that the sliding block 14 rests against that end of the elongate slot 13 which is on the bell-crank lever side. This results in a rigid connection between accelerator pedal and throttle valve, with the result that a further deflection of the accelerator pedal is associated with a proportional adjustment of the throttle valve 2. The adjustment of the throttle valve 2 here takes place counter to the force of the spring 21, in that the two linkage parts 19 and 20 are pulled apart. In the case of a further displacement of the accelerator pedal as far as full load, the position of the adjusting linkage 4 according to FIG. 3 is reached. The throttle valve 2 is fully opened and the spring 21 under maximum prestress. Ventilation of the actuator 15 merely leads to the two linkage parts 19 and 20 being displaced one inside the other with simultaneous relaxation of the spring 21. The position of the throttle valve 2 does not change during this process.

Figure 4:
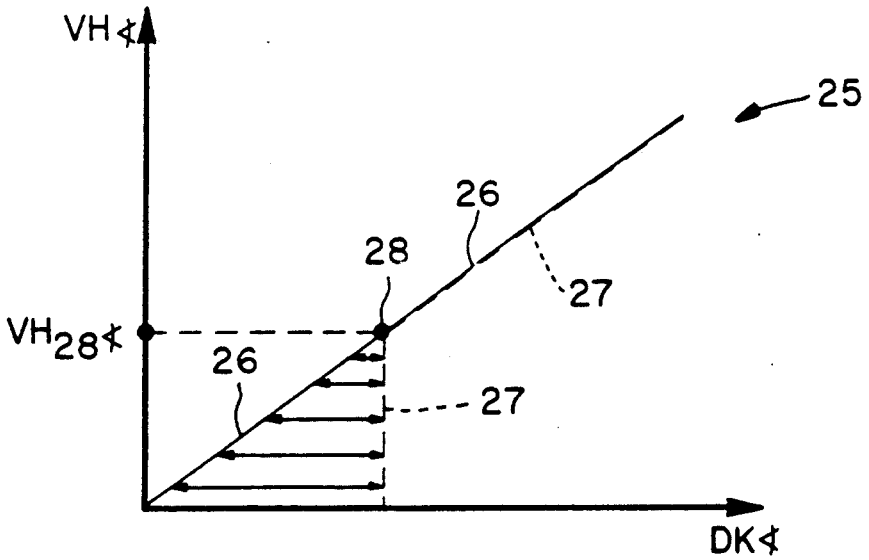
FIG. 4 shows a diagram comparing the relationship of adjustment angle of the accelerator pedal and of the throttle valve under certain operating conditions.

FIG. 4 illustrates, in a diagram where VH =f(DK ), the relationship between the adjustment angle (VH ) of the accelerator pedal and the adjustment angle (DK ) of the throttle valve 2 when the actuator 15 is ventilated and when it is subjected to a vacuum. In this diagram 25, the adjustment angle (DK ) of the throttle valve 2 is plotted on the abscissa and the adjustment angle of the accelerator pedal is plotted on the ordinate. In the diagram 25, the solid characteristic 26 represents the relationship between adjustment angle of the accelerator pedal and adjustment angle of the throttle valve 2 when the actuator 15 is subjected to a vacuum. This relationship when the actuator 15 is ventilated is illustrated by the dashed characteristic 27. The diagram 25 shows that, from point 28 of the characteristic, the adjustment angle of the throttle valve 2 is independent of whether the actuator 15 is ventilated or subjected to a vacuum. The diagram further more shows that, starting from zero load up to a load value ($VH_{28}$) corresponding to a point 28 of the characteristic, the correction, starting from zero load, of the throttle valve position effected by the actuator 15 is steadily reduced up to point 28 of the characteristic. Within the context of the invention, provision is made that the control of the actuator 15 should be effected as a function of the operating parameters internal combustion engine speed, coolant temperature and atmospheric pressure. The actuator 15 is here controlled in such a way that the control chamber 24 is subjected to a vacuum within a range of about 1000 to 2500 rpm and a coolant temperature of about 40 to about 100° C. In the remaining operating ranges of the internal combustion engine, on the other hand, the control chamber 24 is ventilated.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Actuating device for a throttle valve arranged in an intake pipe of a diesel internal combustion engine, having a mechanical adjusting linkage for the load-dependent adjustment of the throttle valve, which linkage has an idle path decoupling the movement of the throttle valve form the movement of an accelerator pedal, wherein an actuator actuated by an auxiliary force is provided, via which actuator the throttle valve position predetermined as a function of load can be altered within an idle path of the actuator;

wherein the actuator is a vacuum actuator with a control diaphragm clamped in a housing;

wherein the control diaphragm is coupled to the throttle valve via an actuating rod, the actuating rod comprising two linkage parts which can be displaced telescopically one inside the other and can be pulled apart counter to the force of a spring.

2. Actuating device according to claim 1, further comprising means for rigidly connecting the accelerator pedal with the throttle valve when the control diaphragm is acted upon by a vacuum.

* * * * *